US007071897B2

(12) United States Patent
Bronson

(10) Patent No.: US 7,071,897 B2
(45) Date of Patent: Jul. 4, 2006

(54) IMMERSIVE AUGMENTATION FOR DISPLAY SYSTEMS

(75) Inventor: Barry Bronson, Saratoga, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 504 days.

(21) Appl. No.: 09/906,662

(22) Filed: Jul. 18, 2001

(65) Prior Publication Data

US 2003/0016236 A1 Jan. 23, 2003

(51) Int. Cl.
*G09G 5/00* (2006.01)

(52) U.S. Cl. ..... 345/7; 345/632

(58) Field of Classification Search ..... 345/7–9, 345/168, 629–633, 698, 353; 353/30, 122; 434/43–44; 348/115, 121
See application file for complete search history.

(56) References Cited

U.S. PATENT DOCUMENTS

| | | | | |
|---|---|---|---|---|
| 4,348,186 | A | 9/1982 | Harvey et al. | 434/44 |
| 4,634,384 | A | 1/1987 | Neves et al. | 434/44 |
| 5,071,209 | A | 12/1991 | Chang et al. | 359/19 |
| 5,136,675 | A | 8/1992 | Hodson | 385/116 |
| 5,242,306 | A | 9/1993 | Fisher | 434/44 |
| 5,487,665 | A * | 1/1996 | Lechner et al. | 434/44 |
| 5,579,026 | A | 11/1996 | Tabata | 345/8 |
| 5,886,675 | A * | 3/1999 | Aye et al. | 345/7 |
| 5,917,460 | A | 6/1999 | Kodama | 345/8 |
| 5,963,247 | A * | 10/1999 | Banitt | 348/121 |
| 5,980,044 | A | 11/1999 | Cannon et al. | 353/30 |
| 6,208,318 | B1 * | 3/2001 | Anderson et al. | 345/1.1 |
| 6,437,759 | B1 * | 8/2002 | Turner et al. | 345/8 |
| 6,547,400 | B1 * | 4/2003 | Yokoyama | 345/39 |
| 2002/0057279 | A1 * | 5/2002 | Jouppi | |

* cited by examiner

*Primary Examiner*—Regina Liang

(57) ABSTRACT

A display system is capable of displaying images of high resolution on a main screen, and augmentation images in augmentation regions located around the main screen. The viewing experience is enhanced by the presence of the augmentation images because of the increase in visual information conveyed to viewers. The augmentation regions lie outside of the foveal field of view of the viewers, so the augmentation images can be of lower resolution than the high resolution images. The use of lower resolution augmentation images reduces the cost of the display system.

28 Claims, 9 Drawing Sheets

IMMERSIVE AUGMENTATION FOR DISPLAY SYSTEMS

TECHNICAL FIELD

The technical field is image display systems. More particularly, the technical field is augmenting a visual experience by expanding the field of view of imagery.

BACKGROUND

In general, apparatuses for displaying images are known. One type of display device is the large screen direct view television. Large screen direct view televisions can be cathode ray tube (CRT) displays, liquid crystal displays (LCD), or plasma screen displays, and can have diagonal sizes of up to 5 feet. Large screen direct view televisions provide high picture quality, but are very expensive. The cost of large screen direct view televisions increases dramatically with increased size.

An alternative to large screen televisions is the projection television. Projection televisions include a screen and a projector mounted either in front of or behind the screen. Projection televisions for home use can have large diagonal sizes, and provide a relatively large field of view at a reasonable cost. However, the field of view provided by projection televisions is limited to the area of the projection screen.

Public movie theaters use projection systems, typically film projectors, to display images on a screen at the front of a theater. These projection systems provide high quality images on the screen. However, the field of view in theater projection systems is also limited to the area of the projection screen.

The above systems are all capable of displaying images of high quality, but have limited visual effect because the viewing experience is limited to a relatively small region defined by the display screen. The peripheral regions of a human's sight provide an avenue to convey visual information that is not utilized by the conventional systems.

FIG. 1 illustrates a vertical range of vision diagram for a human viewer, the range of vision establishing a human's field of vision. FIG. 2 illustrates the regions of varying visual acuity for a human's left and right eyes while viewing an image together. The inner region 30 of the diagram is a region of relatively high visual acuity. The shaded outer region 32 in the diagram illustrates the portion of a person's field of vision that is of low acuity, but which is also very sensitive to changes in brightness and motion. The outer region 32 includes the peripheral vision. As illustrated by FIG. 2, the acuity of the eyes decreases with increasing angular deviation (both horizontal and vertical) from the line of sight $\ell$.

As shown in FIGS. 1 and 2, the human's range of vision is very wide, and can extend beyond a 180 degree field. It would therefore be desirable to present imagery across the entire range of vision when displaying, for example, an entertainment program. However, because of the decreasing acuity with increasing distance from the line of sight $\ell$, it may not be desirable to provide high resolution imagery in the peripheral regions of a human's vision. This is true because it is generally more costly to present high resolution imagery, and the human viewer cannot perceive the high resolution in the peripheral region. Further, the cost to store, process, and transfer high resolution image signals further increases the cost and complexity of display devices.

There is therefore a need for a method of displaying images that presents images to an expanded region of a viewer's field of vision. There is also a need for expanding the field of view without incurring undue cost or complexity.

SUMMARY OF INVENTION

The present invention overcomes the shortcomings of the conventional art and may achieve other advantages not contemplated by the conventional art.

According to a first aspect, a display system includes a main screen, and a main projector arranged to project high resolution images on the main screen. The display system also includes augmentation light sources and projectors arranged to provide augmentation images on augmentation regions disposed around the main screen. The augmentation images are keyed to the color, motion, and brightness of the high resolution images.

According to the first aspect, the viewing experience of viewers is enhanced by expanding the field of view around the main screen. Viewers perceive all of the visual information from the main screen, plus additional information displayed in the augmentation images. In addition, the resolution displayed in each of the augmentation regions can be matched to the visual acuity of viewers in the room. By using augmentation images matched to the viewers' visual acuity, it is not necessary to use expensive high resolution display devices to augment the high resolution image. The viewing experience is therefore enhanced without an excessive increase in cost.

According to a second aspect, a display system displays augmentation images using active lighting arrays. The active lighting arrays display images to augment high resolution images displayed on a main screen. The augmentation images can be keyed to the color, motion, and brightness of the high resolution images. The active lighting arrays can be of progressively decreasing resolution towards the peripheral regions of the viewers' field of vision.

According to the second aspect, the viewing experience is enhanced by expanding the field of view around the main screen. By using active lighting arrays of decreasing resolution, the viewing experience may be enhanced without an excessive increase in cost.

Other aspects and advantages of aspects of the invention will be discussed with reference to the figures and to the detailed description of the preferred embodiments.

DETAILED DESCRIPTION

A display system and a method for displaying images will be described below by way of preferred embodiments and with reference to the accompanying drawings.

Figure 3:
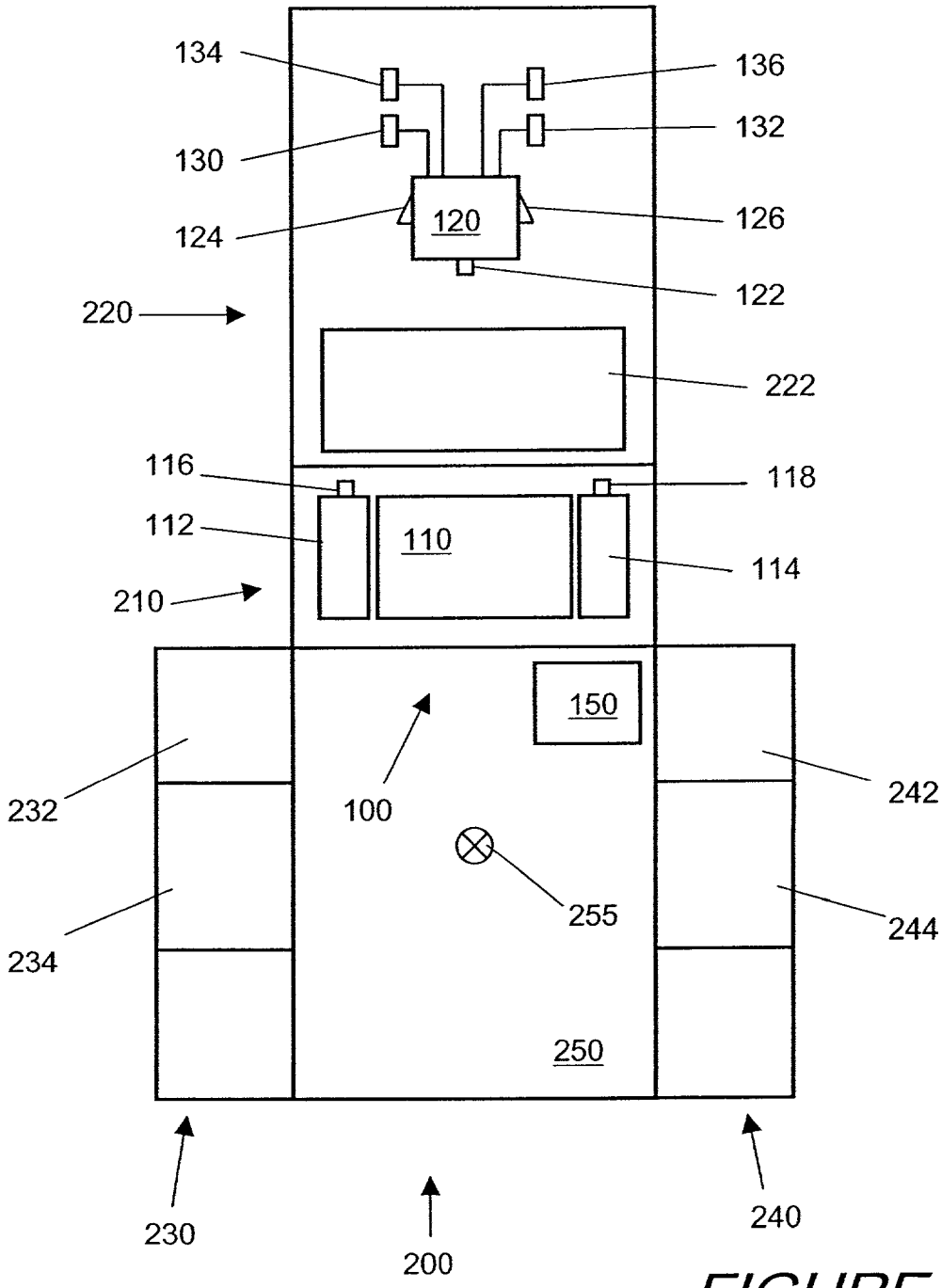
FIG. 3 is a plan view of a display system in a home theater environment.

A first embodiment will be discussed with reference to FIG. 3, which is a plan view of an image display system 100 arranged in a room 200. In FIG. 3, the surfaces of the room 200 are laid flat, or "unfolded." The room 200 includes a front wall 210, a ceiling 220, a left side wall 230, a right side wall 240, and a seating area 250. The rear wall of the room 200 is not shown in FIG. 3.

The display system 100 includes a main screen 110, a left augmentation panel 112, a right augmentation panel 114, a projector 120, and a control 150. The room 200 is illustrated as having a ceiling augmentation region 222, a first left side augmentation region 232, a first right side augmentation region 242, a second left side augmentation region 234, and a second right side augmentation region 244. These regions, along with the left augmentation panel 112 and the right augmentation panel 114, are "augmentation regions." The display system 100 is arranged in the room 200 to display high resolution images on the main screen 110, and to display lower resolution, "augmentation images" on the augmentation regions.

The augmentation images displayed in the augmentation regions augment and supplement the visual effect of the high resolution images displayed on the main screen 110. Advantageously, the augmentation images may be matched, or "keyed" to visual characteristics of the high resolution images. By keying the augmentation images to visual characteristics of the images on the main screen 110, the perceived action and scenery in the high resolution image is extended, thereby enhancing the viewing experience for viewers located in a seating area 250.

The projector 120 includes a main projector 122 that projects the high resolution images onto the main screen 110. The projector 120 also includes a left panel projector 124 and a right panel projector 126. The left panel projector 124 projects augmentation images onto the left augmentation panel 112, and the right panel projector 126 projects augmentation images onto the right augmentation panel 114. The projector 120 can additionally include a first left side light source 130, a first right side 132 light source, a second left side light source 134, and a second right side light source 136. The first left and right side light sources 130, 132 project augmentation images onto the first left and right side augmentation regions 232, 242, respectively. The second left and right side light sources 134, 136 project augmentation images onto the second left and right side augmentation regions 234, 244, respectively.

The display system 100 can also include a left ceiling light source 116 and a right ceiling light source 118. The left and right ceiling light sources 116, 118 project images onto the ceiling augmentation region 222. The left and right ceiling light sources 116, 118 can be mounted on the left and right augmentation panels 112, 114, respectively.

The control 150 is operatively connected to the projector 120, the left ceiling light source 116, and the right ceiling light source 118, and provides display signals to each of the projectors and light sources in the display system 100. Each display signal may be specific to the resolution of the image to be projected by a respective projector or light source. Specifically, the control 150 provides a high resolution display signal to the projector 120, which the main projector 122 projects as a high resolution image onto the main screen 110. The control 150 also provides lower resolution augmentation display signals to the projector 120. For example, the control 150 provides augmentation display signals that the left and right panel projectors 124, 126 project as augmentation images onto the left and right augmentation panels 112, 114, respectively. The augmentation display signals are generated by the control 150 such that images projected onto the left and right augmentation panels 112, 114 are keyed to visual characteristics of the high resolution image.

The control 150 also provides augmentation display signals for display by the first left and right side light sources 130, 132. These augmentation display signals convey image data of lower resolution than the augmentation display signals provided for display by the left and right panel projectors 124, 126, and may be of low resolution. The augmentation display signals for display by the first left and right side light sources 130, 132 are also keyed to visual characteristics of the high resolution image.

The control 150 provides augmentation display signals of still lower resolution for display by the second left and right side light sources 134, 136. These images are displayed on the second left and right side augmentation regions 234, 244, respectively. The images displayed on the first left and right side augmentation regions 234, 244 may be of very low resolution.

Figure 1:
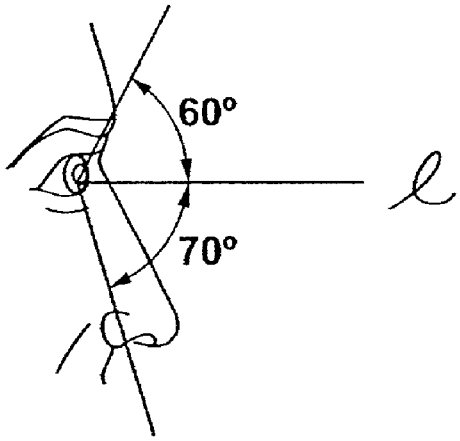
FIG. 1 is a vertical range of vision diagram.
Figure 2:
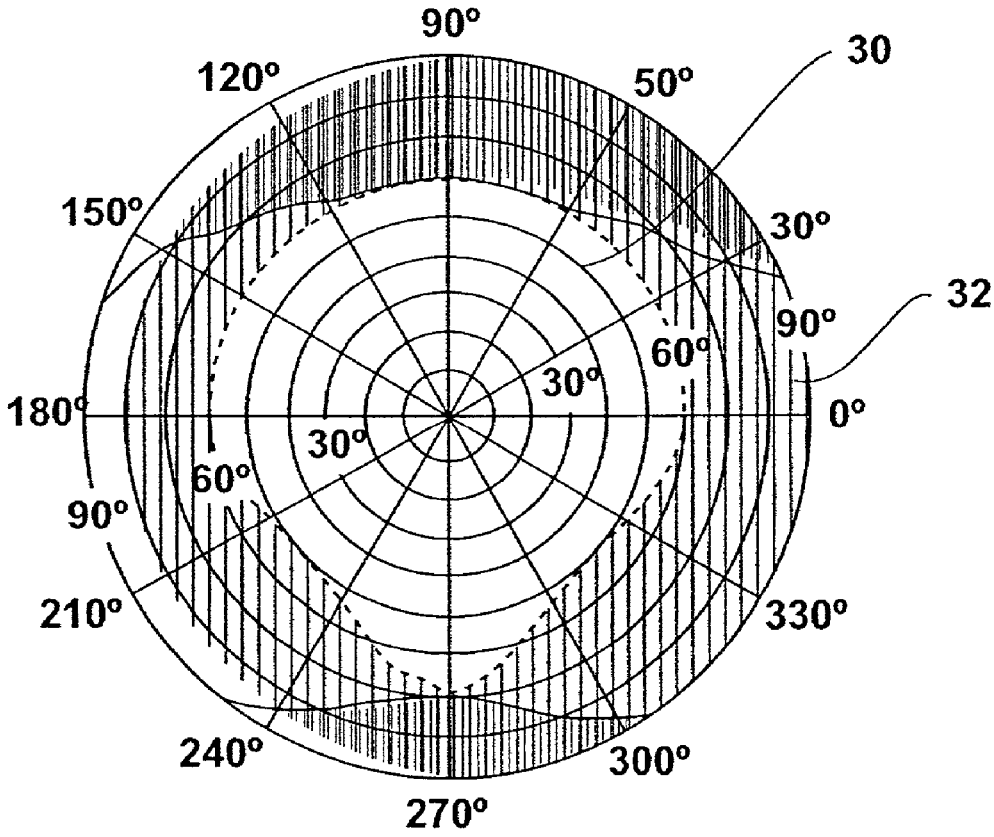
FIG. 2 illustrates regions of varying visual acuity.

The resolution of the images displayed in each of the augmentation regions decreases towards the rear of the room 200, and generally tracks the visual acuity of viewers in the room 200. The main screen 110 encompasses the central field of distinct vision—referred to as the field of "foveal" vision. The foveal field of vision is the generally conical field of view surrounding the line of sight $l$ (see FIG. 1). In human beings, the foveal zone of the retina is used for detailed color and pattern vision. The main projector 122 can be of a type selected to provide an image for the foveal field of vision. For example, the main projector 122 can be a CRT projector, a liquid crystal display (LCD) projector, or a "DIGITAL MICRO DEVICE"™ projector.

The resolution of the image projected by the main projector 122, as perceived by a viewer, may be measured in cycles per degree (CPD). 20:20 vision is defined to be 30 CPD, and 15 CPD equates to 20:40 vision. As viewed from an exemplary viewing location 255 in the room 200, the resolution of the image on the main screen 110 may be, for example, between 15 and 40 CPD.

The surrounding peripheral zone around the line of sight $l$ is sensitive to grosser features of the outer visual field, with the peripheral area of the retina being especially sensitive to movement. The left and right augmentation panels 112, 114 display images in the peripheral zone, yet which are relatively close to the main screen 110. The left and right panel projectors 124, 126 can therefore project images of moderate resolution. The left and right panel projectors 124, 126 may be, for example, film projectors, video projectors, low resolution video projectors, or an array of lights. The images displayed on the left and right augmentation panels 112, 114, as viewed from the viewing location 255, may have a resolution in the range of, for example, of 5 to 30 CPD.

The ceiling augmentation region 222, and the first left and right side augmentation regions 232, 242 are used to display images of low resolution, outside of the foveal field of view. The movement and brightness in the regions 222, 232, 242 need not be exactly matched to the images on the main screen 110. They may instead be matched in a "gross" sense. This gross matching allows for some discontinuity between the main screen 110 and the augmentation regions 222, 232, 242.

Preferably, the augmentation images displayed on the first left side augmentation region 232 are keyed to the images displayed on the left side of the left augmentation panel 112. Similarly, the images displayed on the first right side augmentation region 242 should be keyed to the images displayed on the right side of the right augmentation panel 114, and the images displayed on the ceiling augmentation region 222 should be keyed to the images displayed at the top of the main screen 110. In this manner, the movement and color perceived by the viewer would appear substantially continuous across the field of view.

As viewed from the viewing location 255, the resolution of the images projected by the left and right ceiling light sources 116, 118, and of the first left and right side light sources 130, 132 can be less than, for example, 30 CPD. The resolution of the images may lie in the range of, for example, 1 to 20 CPD. Because the resolution of these images may be relatively low, the light sources 116, 118, 130, 132 may be, for example, low resolution video projectors, or arrays of lights. An example of a suitable array of lights is an array of red, blue and green (RGB) lights. The RGB lights can be constructed of, for example, red, blue and green light bulbs, or LEDs.

The second left and right augmentation regions 234, 244 lie in the far peripheral field of view, which is primarily sensitive to motion. The second left and right side light sources 134, 136 can therefore project images of very low resolution. The second left and right side light sources 134, 136 may include, for example, an array of individually controlled white lights. The white lights can be controlled to convey enough motion information to improve the viewing experience for the viewer. Alternatively, if desired, an array of RGB lights may be used. An array of one or more spotlights can also be used to impart motion and color to the second left and right side augmentation regions 234, 244. For still grosser light effects, an array of one or more white or colored floodlights can be included in the second left and right side light sources 134, 136.

The augmentation regions 222, 232, 234, 242, 244 can be, for example, painted surfaces of the room 200, and projection screens are not required. The main screen 110 is preferably a reflective surface such as a screen found in a conventional projection television system. The left and right augmentation panels 112, 114 are preferably similar to the main screen 110. Alternatively, the left and right augmentation panels 112, 114 may be continuous with the main screen 110.

Figure 4:
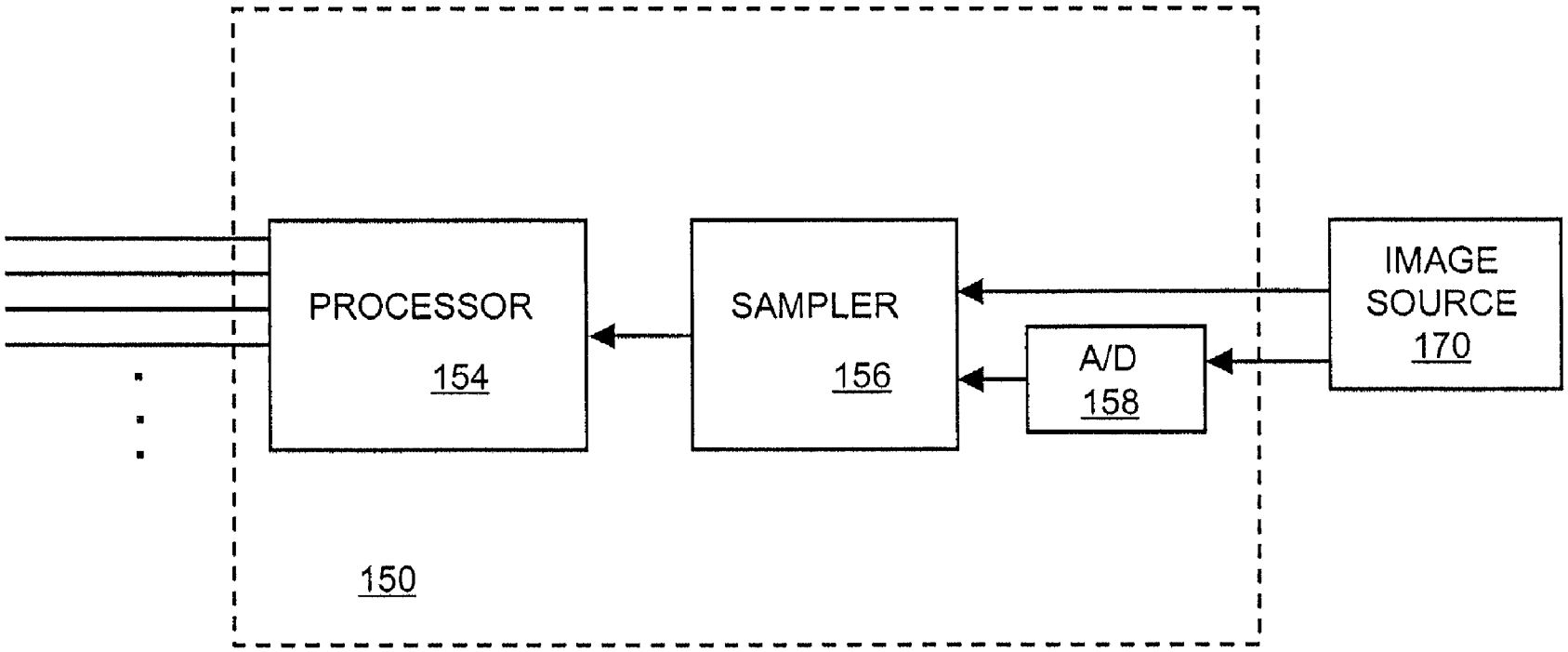
FIG. 4 is a schematic diagram of a control used to generate display signals for the display system illustrated in FIG. 3.

The control 150 will now be discussed with reference to FIGS. 4 and 5. FIG. 4 is a schematic diagram of the control 150. The control 150 includes a processor 154, a sampler 156, and an analog-to-digital converter (ADC) 158. An image source 170 provides source image signals to the control 150. The source image signals may be used to generate both the high resolution display signals and the augmentation display signals.

Figure 5:
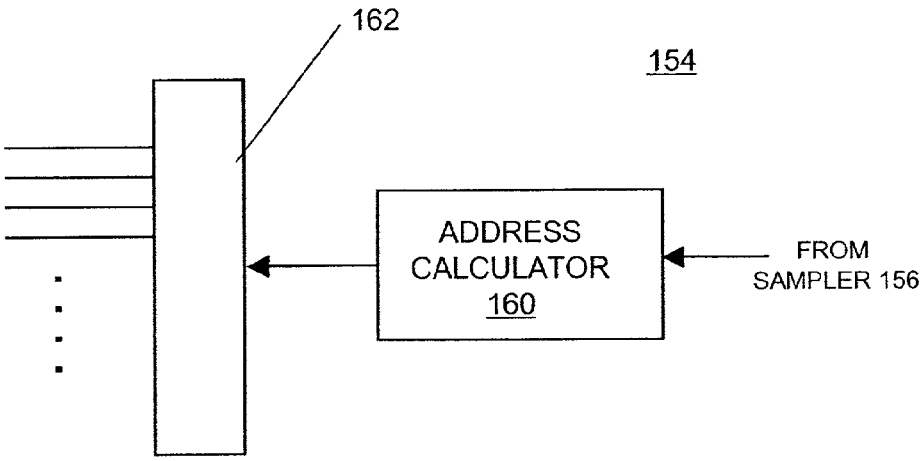
FIG. 5 is a schematic diagram illustrating a processor of the control illustrated in FIG. 4.

FIG. 5 is a schematic diagram illustrating the processor 154. The processor 154 comprises an address calculator 160 disposed to receive image signal data from the sampler 156, and a frame buffer 162 for receiving formatted image data from the address calculator 160. The elements comprising the control 150 and the processor 154 are all illustrated as individual elements for the purposes of illustration, however, one or more of these elements can comprise routines or instructions stored on and executable by, for example, a processing unit or units, software and other computer readable media used in conjunction with a computing device, and other devices capable of executing stored instructions.

The display system 100 may also have audio capability, and an audio signal source can be included to provide source audio signals to the control 150. Speakers may be arranged to receive audio signals from the control 150 and to produce audio output from the audio signals. The audio output produced by the speakers can be correlated with the images displayed by the display system 100 in order to create, for example, a desired entertainment program for viewers in the seating area 250.

The image source 170 can be a storage device capable of storing or buffering image data from an image generating source, a camera device for receiving actual images and reducing the images to electronic form, a videocassette recorder, a DVD, or a combination of these devices. The image source can also be a remote source of image data, such a as a cable or satellite television service. The term "source image signal" is used in this specification to indicate, for example, a digital or an analog signal containing data capable of describing a series of frames of images. If the source image signal is an analog signal, it can be digitized at the ADC 158 before sampling. Alternatively, the source image signal can be forwarded directly to the sampler 156, and processed in the control 150 in the analog domain.

The control 150 uses the source image signal from the image source 170 to generate the high resolution display signals and the augmentation display signals. The generation of the display signals, and a method of displaying images, will now be discussed with reference to FIGS. 4, 5, and 6.

As illustrated in FIG. 5, the processor 154 includes multiple outputs. The multiple outputs represent lines for communicating the display signals transmitted to the various projectors and light sources in the display system 100. In the embodiment illustrated in FIGS. 4–6, each of the projector 120, the left ceiling light source 116, the right ceiling light source 118, the left panel projector 124, the right panel projector 126, the first left side light source 130, the first right side light source 132, the second left side light source 134, and the second right side light source 136, receives a different display signal from the control 150.

Figure 6:
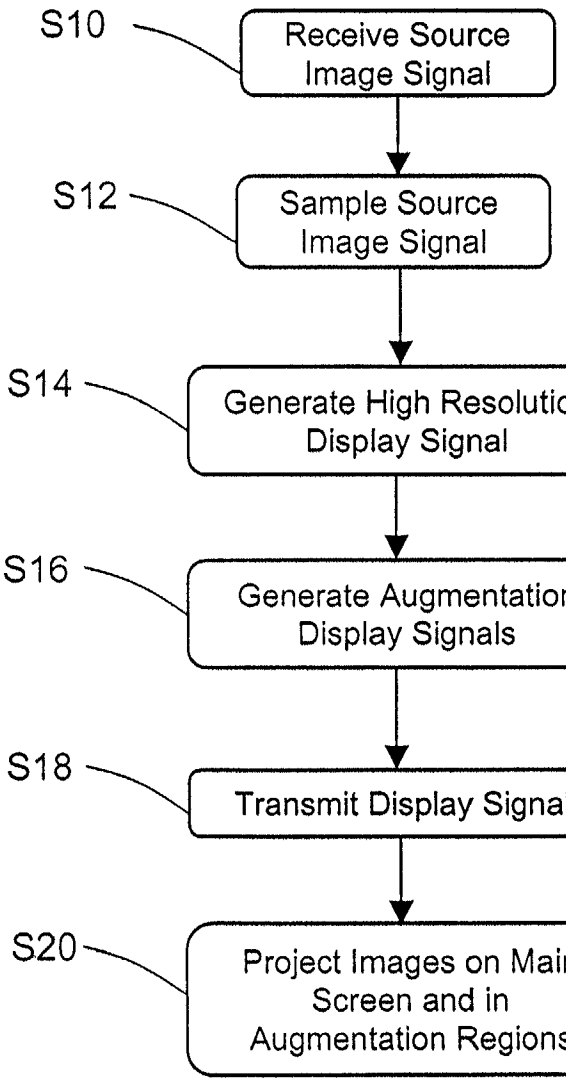
FIG. 6 is a flow chart illustrating a method of displaying images according to an embodiment of the present invention.

FIG. 6 is a flow chart illustrating a method of displaying images using the image display system 100.

In step S10, the sampler receives a source image signal from the image source 170. The sampler 156 samples the source image signal in step S12, and sends the image signal data sampled from the source image signal to the processor 154.

In step S14, the processor 154 generates the high resolution display signal for projection by the main projector 122. The processor 154 generates the high resolution display signals by forwarding the sampled image signal data to the address calculator 160 (see FIG. 5) and transmitting formatted high resolution display data to the frame buffer 162. The frame buffer stores the high resolution display signal for eventual transmission to the projector 120.

The high resolution display signal can be generated from the source image signal in any conventional manner. For example, if the source image signal is provided by a videocassette recorder, the control 150 can process the source image signal for projection as in conventional projection television devices. An electronic source image signal from a cable or satellite television service can be similarly processed to generate the high resolution display signal.

In step S16, the processor 154 generates each of the augmentation display signals using the high resolution display signal. The control 150 generates an augmentation display signal for each of the projectors 122, 124, 126, and the light sources 116, 118, 130, 132, 134, 136. The method for generating the augmentation display signals is discussed in detail below with reference to FIG. 7.

In step S18, the high resolution and the augmentation display signals are transmitted to the projector 120 and to the ceiling light sources. The display signals are routed to their appropriate projector or light source. In step S20, the projectors and light sources project images corresponding to their respective display signals.

Figure 7:
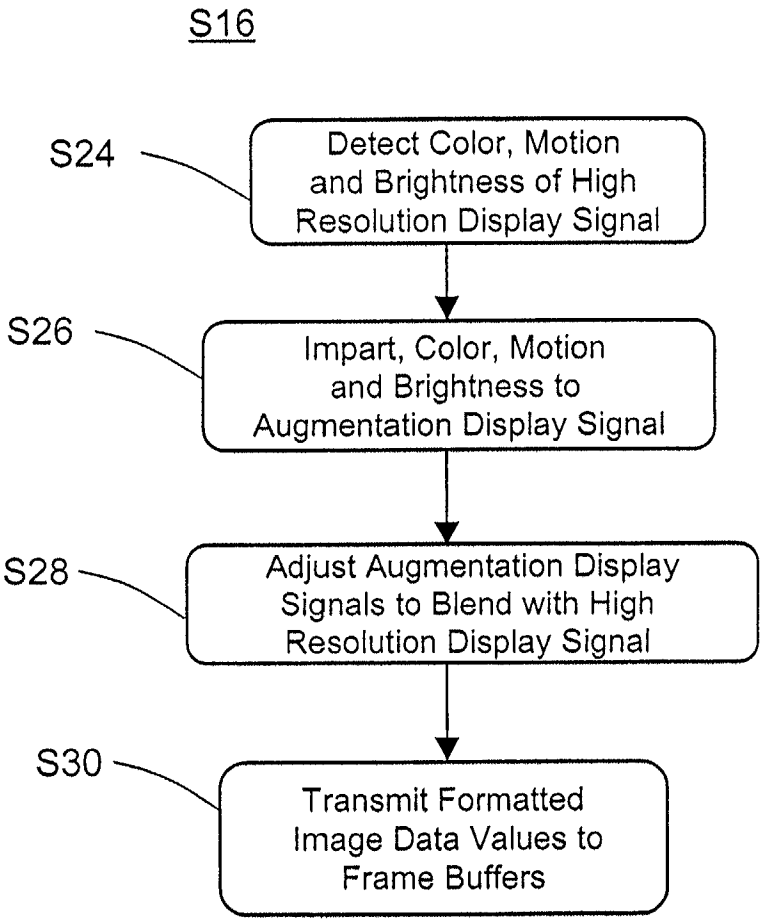
FIG. 7 is a flow chart illustrating generation of augmentation display signals.

FIG. 7 illustrates the steps involved in generating an augmentation display signal, as recited in step S16 of FIG. 6. The discussion of FIG. 7 describes the generation of the augmentation display signal for display by the left augmentation panel 112. The other augmentation display signals may be generated in a similar manner.

In step S24, the processor 154 detects the motion, brightness, and color of an image to be displayed from the high resolution display signal. In step S26, the left panel projector display signal is then generated so that the motion, brightness, and color of an image to be displayed on the left augmentation panel are imparted with the motion, brightness and color of an image to be displayed on the main screen 110.

The sense of motion conveyed by the high resolution display signal may be detected by an algorithm such as those used for creating MPEG motion vectors. The sense of motion from the high resolution signal can be imparted to the augmentation display signal by mapping current and extrapolated motion information into the augmentation display signal by predetermined information in the source image signal, or by predicted information from the motion vectors in the source image signal that are extended into the augmentation regions. The brightness and color conveyed by the high resolution display signal may be detected by analysis of the image information near the edges of the high resolution image, and by combining this information with motion vectors when broad movement (e.g. panning) is detected. The brightness and color of the high resolution image can be imparted to the lower resolution augmentation regions by generating illuminator control signals based on the analysis of brightness and color information in the original high resolution image information. Using the above operations, a display signal for the left panel projector 124 can be generated that will provide an image on the left augmentation panel 112 of lower resolution than the main screen 110, but that is imparted with the motion, brightness and color of the image on the main screen 110.

In step S28, the left panel projector augmentation display signal is adjusted to blend with the high resolution signal so that the left side of the high resolution image on the main screen 110 appears to be substantially continuous with the image on the left augmentation panel 112. One method of blending the high resolution image with the images on the augmentation panels would be to decrease the image resolution at the edges of the high resolution image to approximate the resolution of the images on the augmentation panels. This is referred to as creating a relatively continuous, or "soft" transition zone between the main screen 110 and the augmentation panels. The viewing experience can be enhanced by leaving a small gap between the main screen 110 and the left and right augmentation panels 112, 114.

After adjusting the display signals in step S28, the processor 154 then transmits formatted image data values to the frame buffer 160 in step S30. Referring back to FIG. 6, the formatted image data values are transmitted from the frame buffer 160 as the augmentation display signal for the left panel projector 124.

The augmentation display signals for the right panel projector 126 and the light sources 116, 118, 130, 132, 134, 136 can be generated in a manner similar to the augmentation display signal for the left panel projector 124. For example, the augmentation display signal for the first left side light source 130 can be generated as a further extrapolation of the augmentation image displayed on the left augmentation panel 112, at lower resolution.

According to the above embodiment, the viewing experience is enhanced by expanding the perceived action and scenery from the main screen 110. Therefore, viewers perceive all of the information contained in a source image signal, plus additional information generated in the display system 100. In addition, the resolution displayed in each of the augmentation regions can track the visual acuity of viewers in the room 200. By using augmentation regions matched to the viewers' visual acuity, it is not necessary to use expensive high resolution projection or other display devices to display images on the augmentation regions. The viewing experience is therefore enhanced without an excessive increase in cost.

The display system 100 is illustrated with a front projection device as the main projector 120. As an alternative, the display system 100 could include a rear projection device, with the high resolution image being projected from behind the main screen 110.

As another alternative to using a main projector 122, the main screen 110 can be replaced with a large screen direct view television, such as, for example, a cathode ray tube (CRT) television, a liquid crystal display (LCD) television, or a plasma screen television. The augmentation projectors and light sources would thus augment the images displayed on the large screen television.

Figure 8:
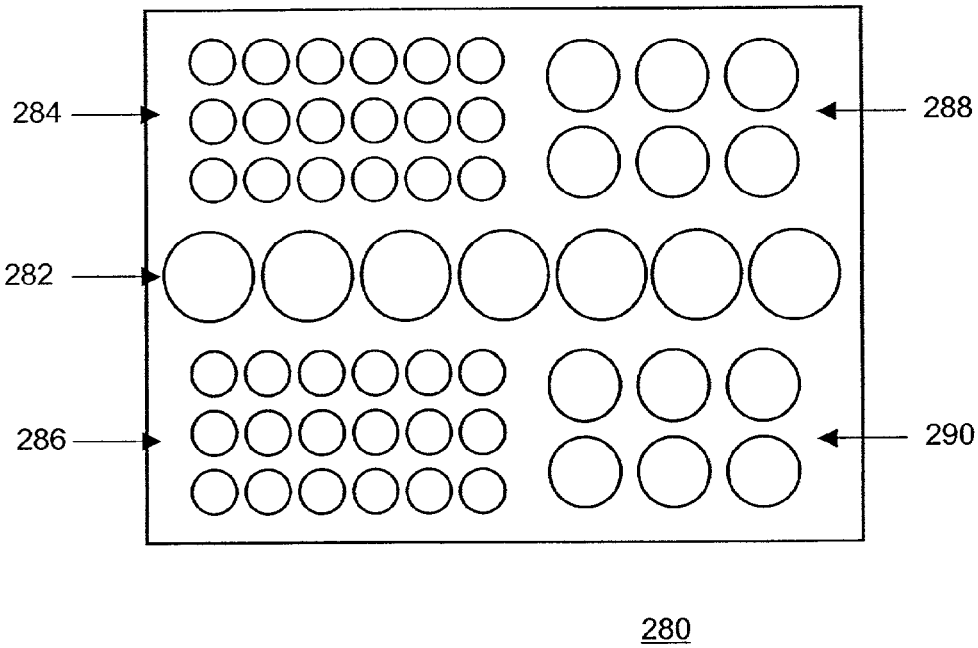
FIG. 8 is a plan view of an active lighting array.

The augmentation regions 112, 114, 222, 232, 234, 242, 244 illustrated in FIG. 3 are passive surfaces for receiving augmentation images. As an alternative, the augmentation regions could include active lighting arrays. In this case, a corresponding projector or light source would not be required, and the augmentation display signal generated by the control 150 would be transmitted to the active lighting array. FIG. 8 illustrates an exemplary active lighting array.

FIG. 8 is a plan view of an active lighting array 280. The device 280 is a "light box," which includes an array of individual light emitting elements. The light box 280 would normally include a diffusion panel, or lens, which is removed in FIG. 8 for illustrative purposes. The light box 280 includes an array 282 of white lights, arrays 284 and 286 of RGB light sources, and arrays 288 and 290 of RGB light sources.

The array 282 of white lights can be used to impart a sense of motion. The arrays 284 and 286 of RGB light sources may be of relatively small size, and can provide relatively high resolution color images. The arrays 288 and 290 of RGB light sources can provide lower resolution color images. The RGB arrays can include, for example, colored lights or LEDs.

In the display system 100, light boxes can be mounted on the walls and ceiling of the room 200. The control 150 would be operatively connected to each of the light boxes to transmit augmentation display signals for display by the light boxes. Light boxes of progressively lower resolution could be used toward the rear of the room 200, minimizing the cost of the display system 100.

In the method illustrated in FIGS. 6 and 7, the image source signal is used to generate the high resolution display signal for projection by the main projector 122, and the high resolution display signal is used to generate the augmentation display signals. As an alternative, an image source signal could be provided that describes a wide enough field of view so that data would not need to be extrapolated in order to generate the augmentation display signals. Specifically, if the source image signal were obtained from a panoramic filming process, the electronic source image signal generated from the panoramic film would contain sufficient image data to generate the high resolution image display signal and the augmentation display signals. Similarly, image data collected from multiple cameras filming a scene could be combined to generate a source image signal covering a wide field of view. In this case, the augmentation display signals would not be an extrapolation of the source image signal, but a selected use of image data from the peripheral regions of the source image.

As another alternative, a source image signal can be generated by using a conventional recording of, for example, a feature film, television show, or other audiovisual work, and extrapolating the image data prior to providing it for use in the display system 100. The image data from the original work could be extrapolated at any time, such as, for example, in post-processing of a feature film, or prior to release to the public in, for example, videocassette format.

Figure 9:
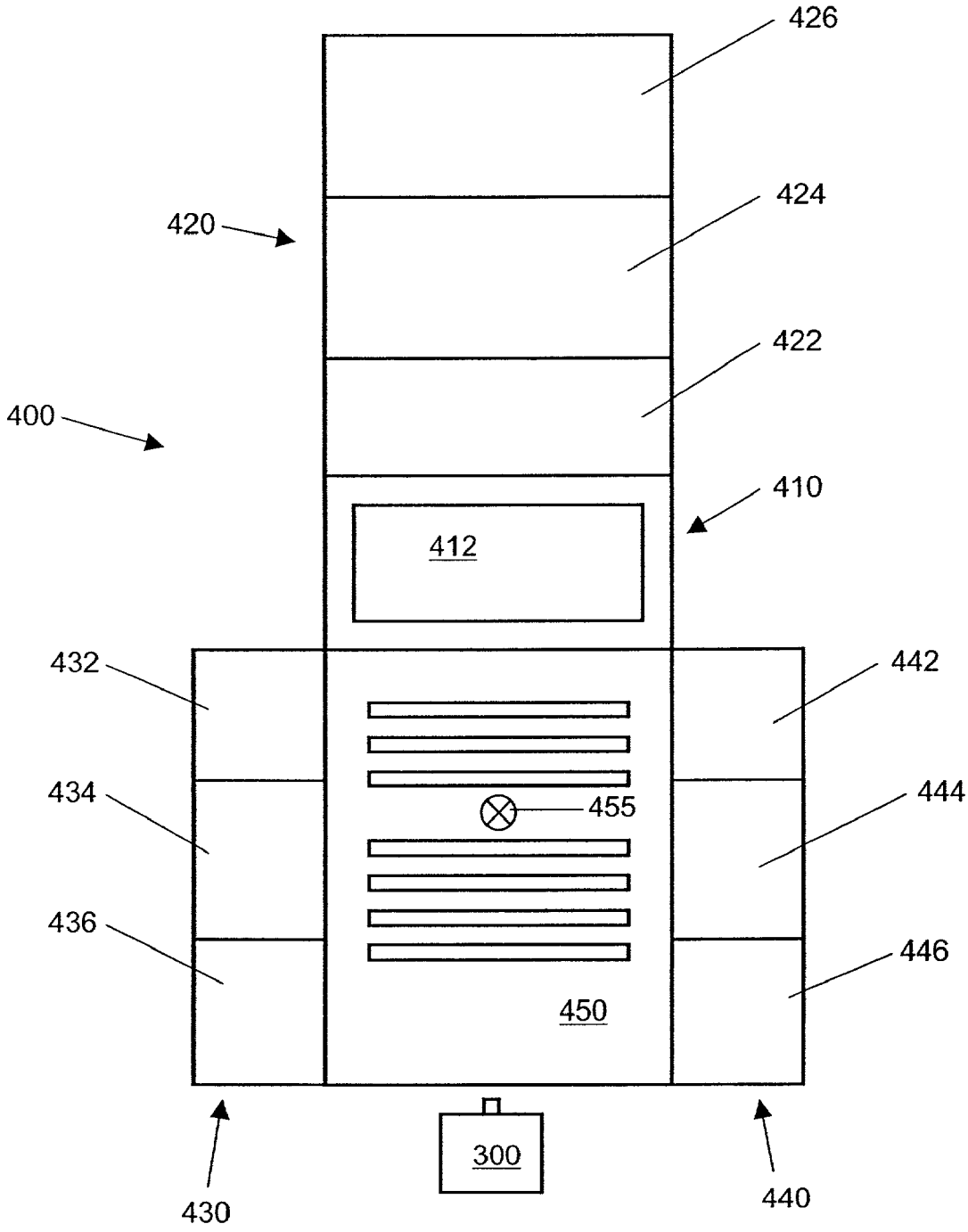
FIG. 9 is a plan view of a display system in a theater environment.

FIG. 9 illustrates an alternative image display system 300, for use in a large room. In FIG. 9, the large room is a theater 400. In FIG. 9, the surfaces of the theater 400 are laid flat, or "unfolded." The theater 400 includes a front wall 410, a main screen 412 mounted on the front wall 410, a ceiling 420, a left side wall 430, a right side wall 440, and a seating area 450. The rear wall of the theater 400 is omitted.

The image display system 300 is arranged to project a high resolution image onto the main screen 412, and reduced resolution augmentation images onto augmentation regions of the theater 400. The augmentation regions in the theater 400 include first, second and third ceiling augmentation regions 422, 424, 426, first, second, and third left side augmentation regions 432, 434, 436, and first, second and third right side augmentation regions 442, 444, 446. In general, the image display system 300 projects higher resolution images onto the augmentation regions at the front of the theater 400, and lower resolution images onto the augmentation regions at the back of the theater.

Figure 10:
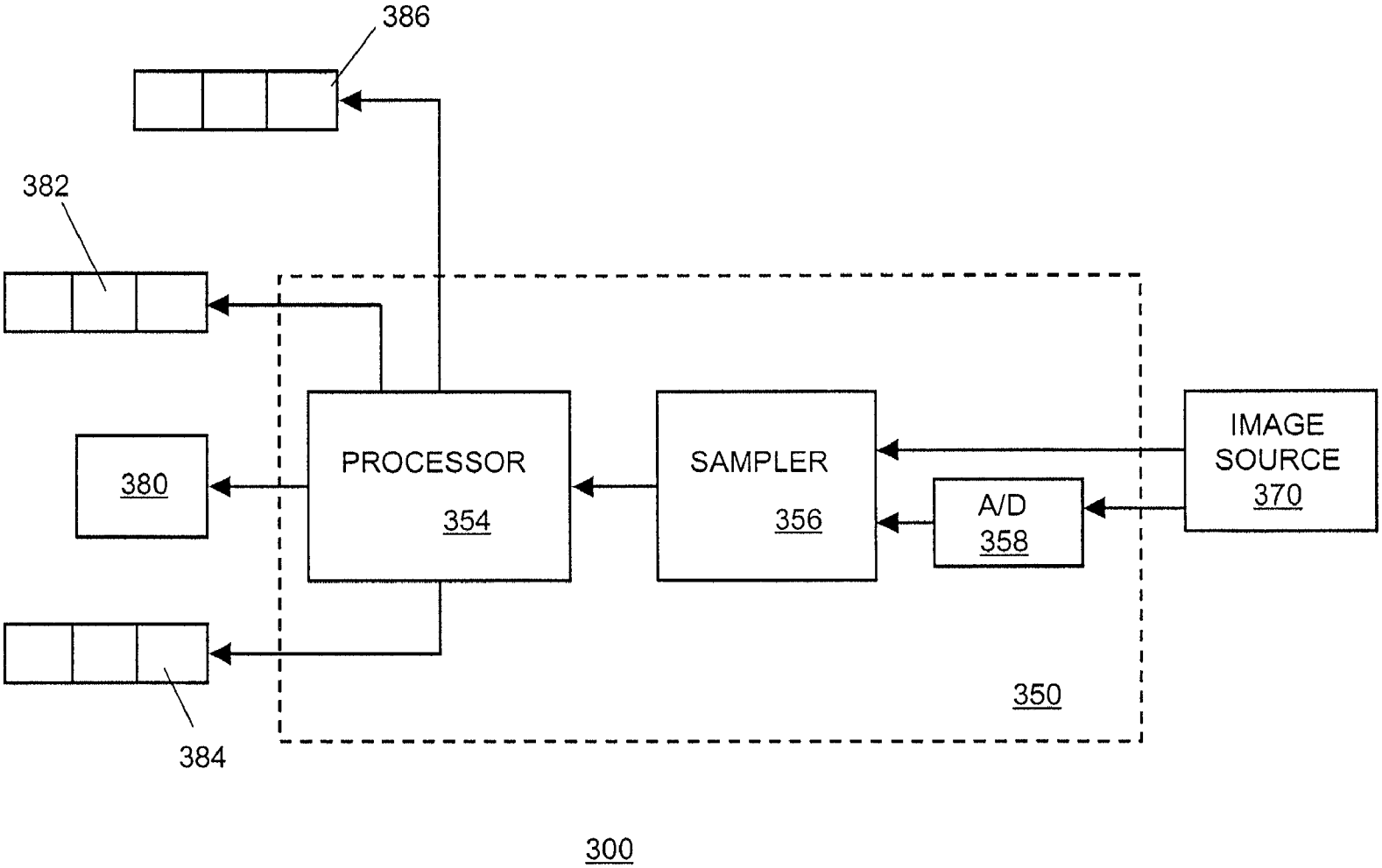
FIG. 10 is a schematic diagram of the display system illustrated in FIG. 9.

The display system 300 is illustrated in detail in FIG. 10. The display system 300 includes a control 350, an image signal source 370, a main projector 380, a right side light source 382, a left side light source 384, and a ceiling light source 386. The control 350 is operatively connected to the image source 370 to receive a source image signal. The control 350 outputs display signals to the projectors and light sources for display in the theater 400.

The main projector 380 is arranged in the theater 400 to project high resolution images on the main screen 412. The main projector 380 can be, for example, a film or video projector. The main projector 380 can project images, as viewed from an exemplary viewing location 455, having a resolution of, for example, between 15 and 40 CPD.

The right side light source 382, the left side light source 384, and the ceiling light source 386 are augmentation light sources. Each of the right side light source 382, the left side light source 384, and the ceiling light source 386 may include a plurality of separate light sources. In the embodiment illustrated in FIG. 10, each of the light sources 382, 384, 386 includes three separate light sources.

The right side light source 382 includes a first light source of moderate resolution for projecting images on the first right side augmentation region 442 illustrated in FIG. 9. The right side projector 382 also includes a second light source for providing images of low resolution on the second right side augmentation region 444, and a third light source for providing very low resolution images on the third right side augmentation region 446. The left side light source 384 can also include light sources of moderate, low, and very low resolution, for displaying images on the first, second, and third right side augmentation regions, 442, 444, 446, respectively. The ceiling light source 386 can also include light sources of moderate, low, and very low resolution, for displaying images on the first, second, and third ceiling augmentation regions 422, 424, 426 respectively.

The moderate resolution light sources discussed above can project images having a resolution, as viewed from the location 455, in the range of, for example, 5 to 30 CPD. The moderate resolution light sources can include, for example, an array of RGB lights, LEDs, or a low resolution video projector.

The low resolution light sources can project images having a resolution of less than, for example, 30 CPD. The resolution may lie in the range of, for example, 1 to 20 CPD. The low resolution light sources can include, for example, an array of RGB lights, white lights, or LEDs.

The very low resolution light sources can be, for example, and array of RGB lights or LEDs. The very low resolution light sources can also include an array of white lights, spotlights, or floodlights.

The control 350 can generate display signals in a manner similar to the control 150 illustrated in FIG. 3, according to the method shown in the flow charts of FIGS. 6 and 7. For example, the control 350 may generate the augmentation display signals for projection by the moderate resolution light sources by determining, for example, one or more of the motion, brightness or color characteristics from the high resolution display signal. The images projected by the low resolution light sources can be similarly keyed to the motion, brightness, and color of the high resolution image.

Figure 11:
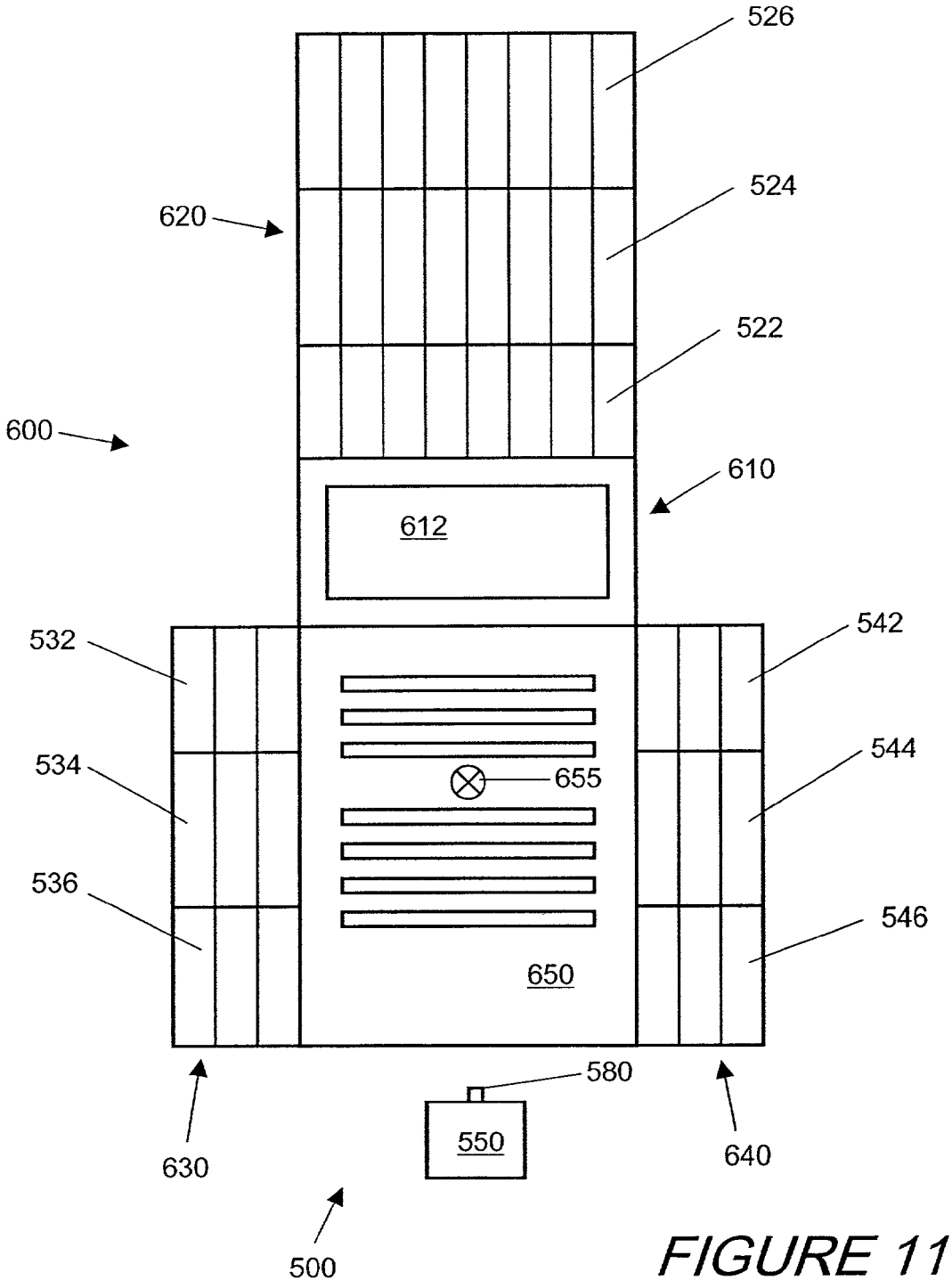
FIG. 11 is a plan view of an alternative display system in a theater environment.

FIG. 11 illustrates an alternative image display system 500, for use in a large room. In FIG. 11, the large room is a theater 600. In FIG. 11, the surfaces of the theater 600 are laid flat. The theater 600 includes a front wall 610, a ceiling 620, a left side wall 630, a right side wall 640, a seating area 650, and a main screen 612 mounted on the front wall 610. The rear wall is omitted.

The image display system 500 illustrated FIG. 11 is similar to the image display system 300 illustrated in FIGS. 9 and 10, except that the image display system 500 includes active lighting arrays, or "augmentation arrays," disposed in the theater 600. The augmentation arrays display augmentation images that augment the images projected on a main screen 612.

The image display system 500 includes a control 550, and a main projector 580 that projects images onto the main screen 612. The augmentation arrays of the image display system 500 comprise first, second and third ceiling arrays 522, 524, 526, first, second, and third left side arrays 532, 534, 536, and first, second and third right side arrays 542, 544, 546.

The main projector 580 is arranged to project a high resolution image onto the main screen 612. The control 550 transmits augmentation display signals to the augmentation arrays, so that the augmentation arrays can display augmentation images to augment the images on the main screen 612. In general, the resolution of the augmentation arrays at the front of the theater 600 is higher than the augmentation regions at the back of the theater 600.

The first ceiling array 522, the first left side array 532, and the first right side array 542 can be of low resolution, and can have resolution of, for example, less than 30 CPD. The resolution can lie in the range of, for example, 1 to 20 CPD, as viewed from a location 655. These arrays can include, for example, an array of RGB lights, or LEDs.

The second ceiling array 524, the second left side array 534, and the second right side array 544 can be of very low resolution. These arrays can include, for example, arrays of RGB lights or LEDs, arrays of white lights, floodlights, or spotlights.

The third ceiling array 526, the third left side array 536, and the third right side array 546 can be of lower resolution than the arrays 522, 532, 542. These arrays can also include, for example, arrays of RGB lights or LEDs, and arrays of white lights, floodlights, and spotlights.

Figure 12:
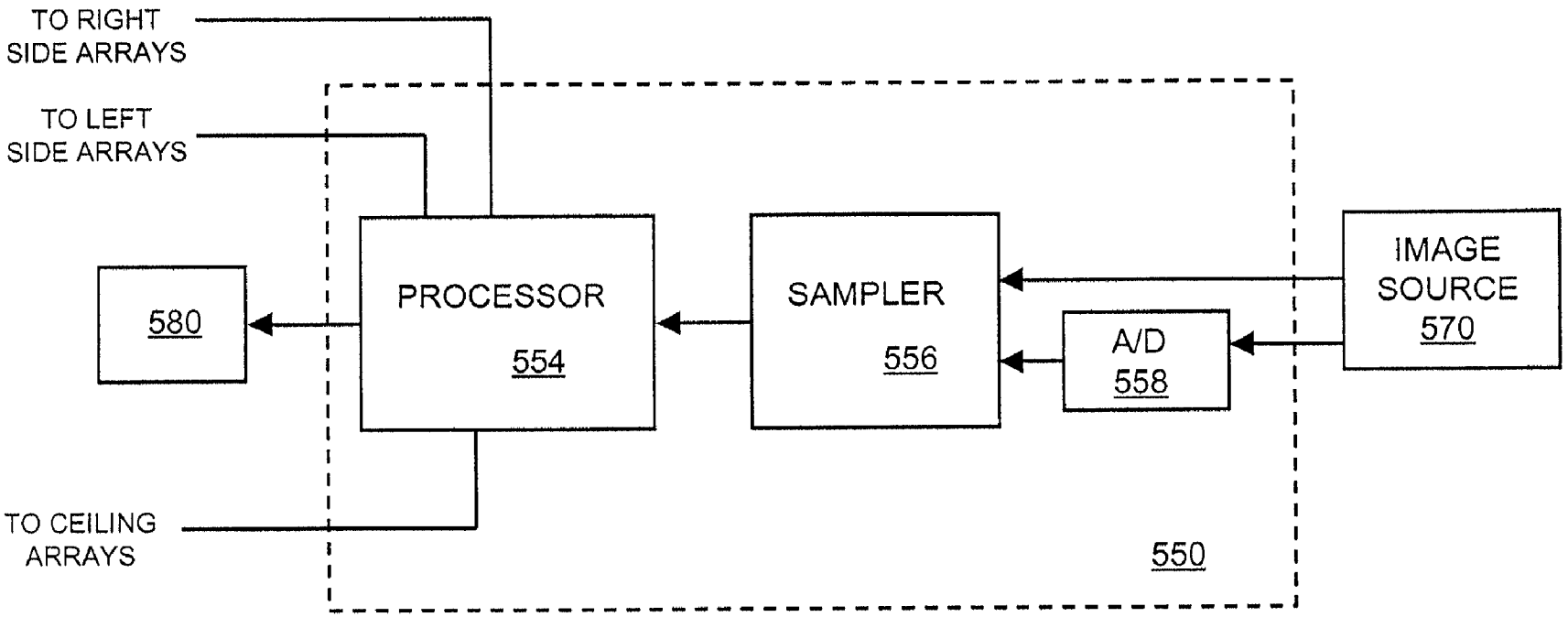
FIG. 12 is a schematic diagram of the display system illustrated in FIG. 11.

The control 550 of the display system 500 is illustrated in detail in FIG. 12. The control 550 is connected to an image source 570 to receive a source image signal. The control 550 is also connected to the main projector 580 to output high resolution display signals to the main projector 580. Transmission lines extend from the control 550 to the left side arrays 532, 534, 536, the right side arrays 542, 544, 546, and to the ceiling arrays 522, 524, 526.

The control 550 can generate display signals in a manner similar to the control 150 illustrated in FIG. 3, according to the method shown in the flow charts of FIGS. 6 and 7. For example, the control 550 can generate the augmentation display signal for display by the first left side array 532 using the source image signal by determining, for example, one or more of the motion, brightness or color characteristics from a high resolution display signal.

In the above embodiments, augmentation regions of moderate resolution are provided on the left and the right of the high resolution image on the main screen. If desired, augmentation regions of moderate resolution could be provided above and/or below the main screen.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise indicated.

What is claimed is:

1. A method of displaying images, comprising:

generating a high resolution display signal;

determining at least one of a motion, brightness or color characteristic from the high resolution display signal;

generating at least one augmentation display signal from the high resolution display signal using the at least one motion, brightness or color characteristic;

displaying a high resolution image using the high resolution display signal, comprising projecting the high resolution image onto a screen; and displaying plural augmentation images onto a plurality of augmentation regions disposed around the screen, by:

projecting a first augmentation image onto a first augmentation region to the right of the screen, projecting a second augmentation image onto a second augmentation region to the left of two screen, and projecting a third augmentation image onto a third augmentation region that is outside a field of foveal view for viewers watching the screen and separate from the first and second augmentation regions, the third augmentation image being produced from an array of lights to convey motion information, but not images, to augment images displayed on screen.

2. The method of claim 1, wherein the array of lights includes individually controlled white lights.

3. The method of claim 1, wherein the array of lights includes an array of red, blue and green lights.

4. The method of claim 1, wherein the array of lights is an array of white lights.

5. The method of claim 1, wherein the array of lights has a resolution lower than the first and second augmentation images.

6. The method of claim 1, wherein the array of lights produces ambient color, not imagery, to augment images on one of the first and second augmentation regions.

7. The method of claim 1, further comprising projecting a fourth augmentation image onto a fourth augmentation region that is outside the field of foveal view and separate from the first, second, and third augmentation regions, the fourth augmentation image conveying color and motion, but not images, to the viewers watching the screen.

8. The method of claim 7, wherein the third augmentation region is left of the first augmentation region, and the fourth augmentation region is right of the second augmentation region.

9. A display system, comprising:

a main screen;

a main projector, wherein the main projector is arranged to project images on the main screen;

a plurality of augmentation projectors, wherein the augmentation projectors are arranged to project augmentation images onto a plurality of augmentation regions disposed around the main screen, wherein the augmentation regions include (1) separate first and second augmentation regions for displaying images adjacent the main screen, and (2) a third augmentation region being outside a field of foveal view of viewers watching the main screen and displaying, at a resolution lower than the images in the first and second augmentation regions, color to convey motion but not images being produced from an array of lights to the viewers watching the main screen; and a control, wherein the control is operatively connected to the main projector to provide high resolution display signals to the main projector, and operatively connected to the at least one augmentation projector to provide augmentation display signals to the at least one augmentation projector, the augmentation display signals being keyed to at least one of the color, motion, and brightness of the high resolution display signals.

10. The display system of claim 9, wherein at least one of the augmentation projectors includes:

an array of red, blue and green lights for projecting the color onto the third augmentation region.

11. The display of claim 10, wherein at least one of the augmentation projectors includes:

an array of white lights for projecting motion onto the third augmentation region.

12. The display system of claim 9, wherein the main screen is disposed on a front wall of a room, an augmentation region is disposed on a side wall to the left of the front wall, an augmentation region is disposed on a side wall to the right of the front wall, and an augmentation region is disposed on a ceiling above the front wall.

13. A display system, comprising:

a main screen;

a main projector, wherein the main projector is arranged to project images on the main screen;

at least one array, wherein the at least one array is arranged to display at least one augmentation image; and a control, wherein the control is operatively connected to the main projector to provide high resolution display signals to the main projector, and operatively connected to the at least one array to provide augmentation display signals to the at least one array, the augmentation display signals generating (1) first augmentation images left of the main screen, (2) second augmentation images right of the main screen, and (3) an array of lights, outside a field of foveal view for viewers of the main screen, that conveys motion information without images to the viewers to augment the images projected on the main screen.

14. The display system of claim 13, wherein the array of lights are displayed at a location separate from the first and second augmentation images, and have a resolution lower than the first and second augmentation images.

15. The display system of claim 14, wherein the array of lights includes red, blue and green lights.

16. The display of claim 15, wherein the array of lights includes an array of white lights.

17. The display system of claim 13, wherein the main screen is disposed on a front wall of a room, an array is disposed on a side wall to the left of the front wall, an array is disposed on a side wall to the right of the front wall, and an array is disposed on a ceiling above the front wall.

18. A method of displaying images, comprising:

projecting an image at a high resolution onto a screen;

continuously extending said image from said screen to a first augmentation region that is right of the screen and to a second augmentation region that is left of the screen, said image being provided at a lower resolution in said first and second augmentation regions;

extending said image from said first augmentation region to a third augmentation region; and extending said image from said second augmentation region to a fourth augmentation region, wherein said third and fourth augmentation regions are produced from an array of lights and have resolutions lower than resolutions of the first and second augmentation regions, wherein the array of lights produces lights in a peripheral area of viewers that is sensitive to motion in order to augment the high resolution image on the screen.

19. The method of claim 18 wherein action and scenery of the image at the high resolution extend into the first and second augmentation regions to supplement visual effects of the screen.

20. The method of claim 18 further comprising providing the first and second augmentation regions in a peripheral visual zone separate from the screen.

21. The method of claim 18 wherein the screen encompasses a field of foveal vision and the first and second augmentation regions augment visual effects in the field of foveal vision.

22. The method of claim 18 wherein the image at the high resolution on the screen visually appears to be substantially continuous with the image at the lower resolution on the first and second augmentation regions.

23. The method of claim 18 further comprising importing motion, brightness, and color of the image at the high resolution onto the image at the lower resolution.

24. A display system, comprising:

a main screen;

first and second augmentation regions adjacent the main screen; and image generation means for generating a first image at a first resolution on the main screen and a second image at a second resolution on the first augmentation region and a third image at a third resolution on the second augmentation region, wherein the first resolution is higher than the second resolution, the second resolution is higher than the third resolution, the second image blends with the first image so the second image is substantially continuous with the first image from the main screen to the first augmentation region, and the third image is produced from an array of lights controlled to convey motion information, but not images, to viewers to augment images projected onto the main screen.

25. The display system of claim 24 wherein action and scenery of the first image extend into the second image.

26. The display system of claim 24 wherein:

the main screen encompasses a generally conical field of view surrounding a line of sight onto the main screen;

the augmentation region is located in a peripheral zone to the line of sight.

27. The display system of claim 24 further comprising plural additional augmentation regions, wherein the main screen is located in a field of foveal view, and the plural additional augmentation regions are located outside the field of foveal view.

28. The display system of claim 24 further comprising additional augmentation regions that display images at resolutions different than the first and second resolutions.

* * * * *

UNITED STATES PATENT AND TRADEMARK OFFICE

CERTIFICATE OF CORRECTION

PATENT NO. : 7,071,897 B2
APPLICATION NO. : 09/906662
DATED : July 4, 2006
INVENTOR(S) : Barry Bronson It is certified that error appears in the above-identified patent and that said Letters Patent is hereby corrected as shown below:

In column 11, line 67, in Claim 1, delete “two” and insert -- the --, therefor.

In column 12, line 7, in Claim 1, after “on” insert -- the --.

Signed and Sealed this

Twenty-eighth Day of April, 2009

John Doll

JOHN DOLL
*Acting Director of the United States Patent and Trademark Office*